US007309961B2

(12) United States Patent
Park et al.

(10) Patent No.: US 7,309,961 B2
(45) Date of Patent: Dec. 18, 2007

(54) DRIVING FREQUENCY MODULATION SYSTEM AND METHOD FOR PLASMA ACCELERATOR

(75) Inventors: Won-taek Park, Seoul (KR); Vladimir Volynets, Yongin-si (KR)

(73) Assignee: Samsung Electronics Co., Ltd., Suwon-si, Gyeonggi-do (KR)

( * ) Notice: Subject to any disclaimer, the term of this patent is extended or adjusted under 35 U.S.C. 154(b) by 0 days.

(21) Appl. No.: 11/274,247

(22) Filed: Nov. 16, 2005

(65) Prior Publication Data

US 2006/0113182 A1 Jun. 1, 2006

(51) Int. Cl.
*H01J 7/24* (2006.01)

(52) U.S. Cl. ..... 315/111.51; 315/111.21; 315/111.61; 118/723 I; 156/345.48

(58) Field of Classification Search ..... 315/111.01–111.91; 118/723, 723 I; 250/492, 250/423, 423 R; 156/345, 345.48; 204/192, 204/298

See application file for complete search history.

(56) References Cited

U.S. PATENT DOCUMENTS 4,849,675 A * 7/1989 Muller ..... 315/111.51
5,234,529 A 8/1993 Johnson ..... 156/345
5,401,350 A * 3/1995 Patrick et al. ..... 118/723 I
5,435,881 A * 7/1995 Ogle ..... 156/345.42
5,531,834 A * 7/1996 Ishizuka et al. ..... 118/723 I
5,554,223 A * 9/1996 Imahashi ..... 118/723 I
5,669,975 A * 9/1997 Ashtiani ..... 118/723 I
5,792,261 A * 8/1998 Hama et al. ..... 118/723 I
6,143,129 A * 11/2000 Savas et al. ..... 156/345.48
6,251,241 B1 6/2001 Shin et al. ..... 204/298.11
6,252,354 B1 * 6/2001 Collins et al. ..... 315/111.51
6,335,535 B1 * 1/2002 Miyake et al. ..... 250/492.21
6,768,120 B2 * 7/2004 Leung et al. ..... 250/423 R
6,850,012 B2 * 2/2005 Edamura et al. ..... 315/111.51
2001/0054383 A1 * 12/2001 Pu et al. ..... 118/723 I
2002/0121345 A1 * 9/2002 Chen et al. ..... 156/345.48
2003/0015965 A1 * 1/2003 Godyak ..... 315/111.21
2003/0057845 A1 * 3/2003 Edamura et al. ..... 315/111.21
2004/0045669 A1 * 3/2004 Okumura et al. ..... 156/345.35
2005/0051272 A1 * 3/2005 Collins et al. ..... 156/345.48
2005/0264218 A1 * 12/2005 Dhindsa et al. ..... 315/111.21

OTHER PUBLICATIONS

Dennis A. Rally et al., "High-Efficiency, Long-Life Pulsed Inductive Plasma Thrusters", Lewis Research Center, Cleveland, Ohio, Jan. 1999, pp. 1-3.

(Continued)

*Primary Examiner*—Douglas W. Owens
*Assistant Examiner*—Tung X Le
(74) *Attorney, Agent, or Firm*—Buchanan Ingersoll & Rooney PC

(57) ABSTRACT

A plasma accelerator (300) is disclosed that has three separate sections of coils (301-316) disposed outside the plasma chamber (321). The separate sections of coils include an initial discharge section (309-316), an acceleration section (303-308), and a nozzle section (301-302). Each section of coils is driven by signals of a different frequency to more efficiently discharge and accelerate a plasma in the plasma accelerator (300).

12 Claims, 5 Drawing Sheets

OTHER PUBLICATIONS

J.T. Scheuer et al., "A Magnetically-Nozzled, Quasi-Steady, Multimegawatt, Coaxial Plasma Thruster", IEEE Transactions on Plasma Science, vol. 22, No. 6, Dec. 1994, pp. 1015-1033.

Raymond W. Palmer et al., "Analytical Investigations of Coil-System Design Parameters For A Constant-Velocity Traveling Magnetic Wave Plasma Engine", Lewis Research Center, Cleveland, Ohio, National Aeronautics and Space Administration, 1964, pp. 1-35, no date.

Alan S. Penfold, "Traveling Wave Plasma Accelerators", Space Science Laboratory Applied Science Division Litton Systems Incorporated, Bevely Hills, California, 1964, pp. 1-17, no date.

* cited by examiner

Optimal frequency vs
the number of coils (N)

DRIVING FREQUENCY MODULATION SYSTEM AND METHOD FOR PLASMA ACCELERATOR

Priority is claimed to Application No. 10-2004-0098487, filed in the Korean Intellectual Property Office on Nov. 29, 2004, the entire contents of which are herein incorporated by reference.

BACKGROUND

1. Field of the Invention

The present invention is related to apparatus for generating plasma, and more particularly to inductively coupled electromagnetic plasma accelerators.

2. Discussion of Related Art

Directed streams of plasma are used in semiconductor fabrication for etching and for thin film deposition. For example, plasma processing equipment is used to manufacture microelectronic logic circuits and display substrates, e.g., liquid crystal display (LCD) panels. Inductively coupled plasma (ICP) accelerators are a type of plasma equipment widely used in semiconductor manufacturing processes. ICP equipment is favored for its ability to generate plasma streams having relatively high plasma density and good uniformity characteristics. As industry is able to produce smaller semiconductor gate widths, more microelectronic circuitry can be included within a single semiconductor device. Increasingly sophisticated plasma equipment is needed to produce the smaller, faster semiconductor circuitry while keeping the manufacturing yields at acceptable rates.

FIG. 1 depicts a cut-away top perspective view of a plasma accelerator 100. The accelerator 100 has a circular channel 110 bounded by chamber walls 112, 114 and 116 on the inside, outside and top, respectively. The chamber walls 112, 114 and 116 typically consist of a dielectric material. The inside wall 112 and outside wall 114 are generally oriented equidistance apart, bounded by chamber wall 116 and one end and open at the other end to form the chamber 110. One or more internal circular coils 118 are provided on the external portion of inside walls 112, and a number of external circular coils 120 are provided on the external portion of outside chamber wall 114. The accelerator 100 may be configured with a circular anode 122 disposed on the inside top portion of chamber 110. Conventional ICP accelerators with an interior anode often use coil driving frequencies at around 13.5 MHz. The use of this frequency has been found to be acceptable in conventional accelerators for the purposes of plasma generation and heating as well as initially accelerating the plasma. A cathode (not shown) may be oriented outside the bottom, open end of circular channel 110. A supply line 124 feeds gas through the top wall 116 of circular channel 110 to the anode 122 which ionizes the gas. FIG. 2 depicts a cross-sectional view of the plasma accelerator 100 shown in FIG. 1. A number of different gases may be used for a deposition or etching plasmas, including, for example, Ar, $F_2$, $Cl_2$, $CH_4$, $GeH_4$, $CF_4$, $SiH_n^+$, either alone, combined with each other, or in combination with $O_2$, $H_2$ and $N_2$.

Another conventional type of plasma accelerator is the traveling wave accelerator. These devices operate by producing a series of magnetic field local maximums moving in axial direction. A traveling wave is attained by using a series of side coils in which the current amplitude and phase can be adjusted and varied in each coil. The local maximums of the Lorentz force $F_L$ and the axial electrostatic ambipolar field $E_Z$ also move in the axial direction, producing additional plasma acceleration in case of a proper choice of the traveling wave velocity. Note that plasma engines of this type are analogous to alternating-current linear-induction motors. Such plasma motors differ essentially only in the production of the traveling wave (or stator), to which the plasma (or rotor) is coupled.

SUMMARY

The present invention addresses these and other concerns. According to one aspect, an apparatus is provided for accelerating a plasma which includes a chamber configured with an end wall and with at least one side wall that is substantially parallel to an axial direction of the chamber. A first coil is disposed adjacent the end wall that operates at a first frequency to generate the plasma in a gas located within the chamber; and a plurality of second coils is disposed around the chamber adjacent the side wall and spaced from one another along the axial direction. The second coils are operated at a second frequency and out of phase with one another to accelerate the plasma along the axial direction.

In another aspect, the present invention involves a method of accelerating a plasma in a chamber. The method includes driving a first coil at a first frequency to generate the plasma in a gas located within a chamber, the first coil being disposed adjacent an end wall of the chamber; and driving a plurality of second coils at a second frequency to accelerate the plasma along an axial direction of the chamber, the second coils being disposed adjacent a side wall and spaced from one another along the axial direction; wherein the second coils being operated at the second frequency are out of phase with one another.

BRIEF DESCRIPTION OF THE DRAWINGS

The above and other objects, features, and advantages of the present invention will become more apparent in light of the following detailed description in conjunction with the drawings, in which like reference numerals identify similar or identical elements, and in which.

DETAILED DESCRIPTION

Exemplary embodiments of the present invention are described below with reference to the accompanying drawings. In the following description, some of the well-known functions and/or constructions may not be described in detail to avoid obscuring the invention in unnecessary detail.

Figure 3:
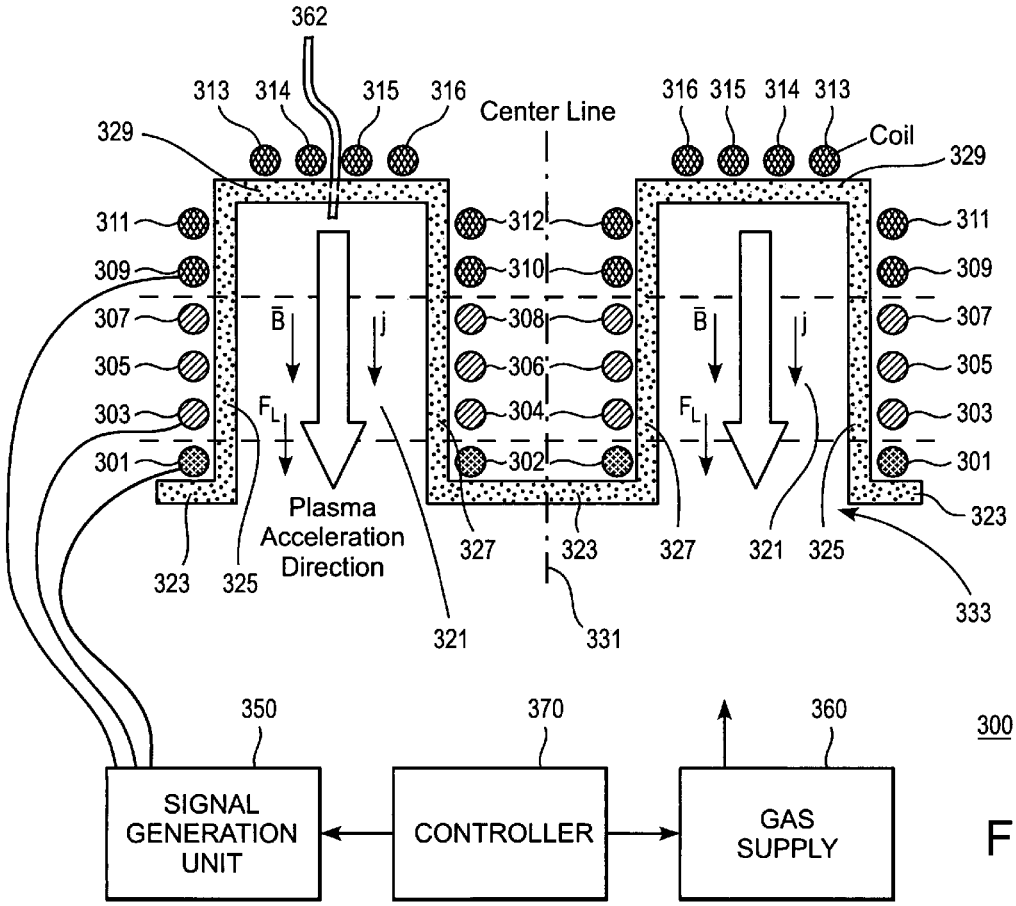
FIG. 3 depicts a cross-sectional view of electromagnetic induced plasma accelerator 300 according to various embodiments of the invention.
Figure 4:
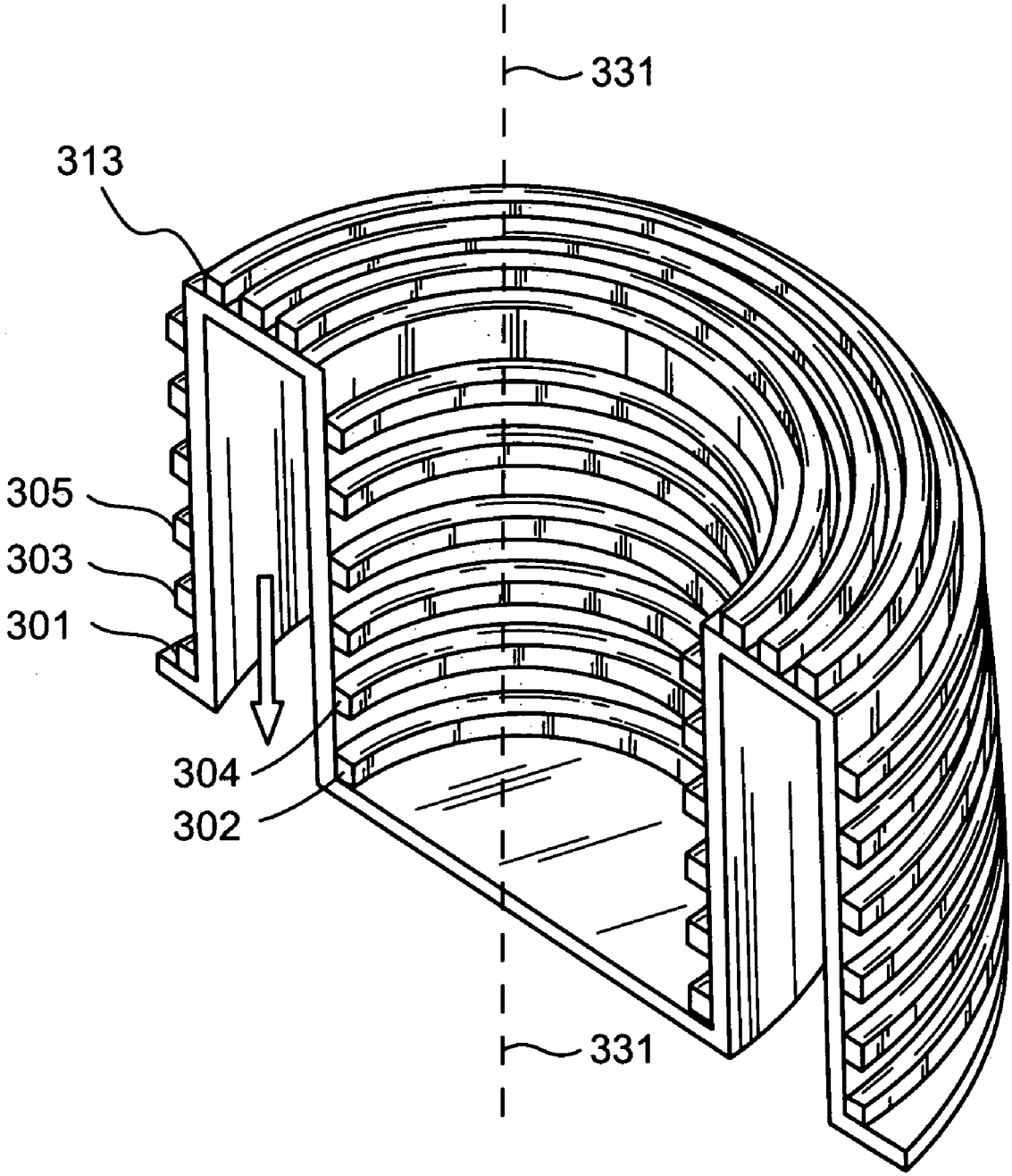
FIG. 4 depicts a cut-away perspective view of the electromagnetic induced plasma accelerator 300.

Turning to the drawings, FIG. 3 depicts a cross-sectional view of electromagnetic induced plasma accelerator 300 according to various embodiments of the invention. The plasma accelerator 300 includes outside chamber wall 325, inside chamber wall 327 and chamber end wall 329 which form a circular channel 321. The circular shape of channel 321 may be more readily observed by viewing FIG. 4 which depicts a cut-away perspective view of the plasma accelerator 300. An end wall 323 is provided for structural support. The opening in chamber 321 near the end wall 323 is called the nozzle 333. The nozzle 333 opening may be known by other, similar names in the art, e.g., aperture, chamber opening, discharge window, or the like. The chamber walls 323-329 are typically formed from a dielectric material. The inside chamber wall 327 and outside chamber wall 329 are equidistant from each other, curving about common axis 331 at a constant radius from the common axis 331 in the exemplary embodiment. The outside chamber wall 325 and the inside chamber wall 327 are substantially parallel to an axial direction of said chamber (e.g., common axis 331). The inner surfaces of inside chamber wall 327, outside chamber wall 329 and chamber end wall bound the chamber 321.

The accelerator 300 includes inner side coils 302, 304, 306, 308, 310 and 312 positioned on the exterior surface of inside chamber wall 327. Accelerator 300 has outer side coils 301, 303, 305, 307, 309 and 311 positioned on the exterior surface of outside chamber wall 325. The accelerator 300 also includes end side coils 313-316 on the chamber end wall 329 arranged in a generally parallel manner between inner side coil 312 and outer side coil 311. Although the example illustrated in FIG. 3 has 16 coils, the invention may be practiced either with fewer coils or with more coils, depending upon the particular characteristics desired and the design constraints of the implementation. The side coils 301-316 are sometimes called circular loop inductors, discharge electrodes, or other such terms known in the art. Side coils 301-316 are positioned coaxially on the outside of chamber walls 323-329, running generally parallel to each other.

Figure 1:
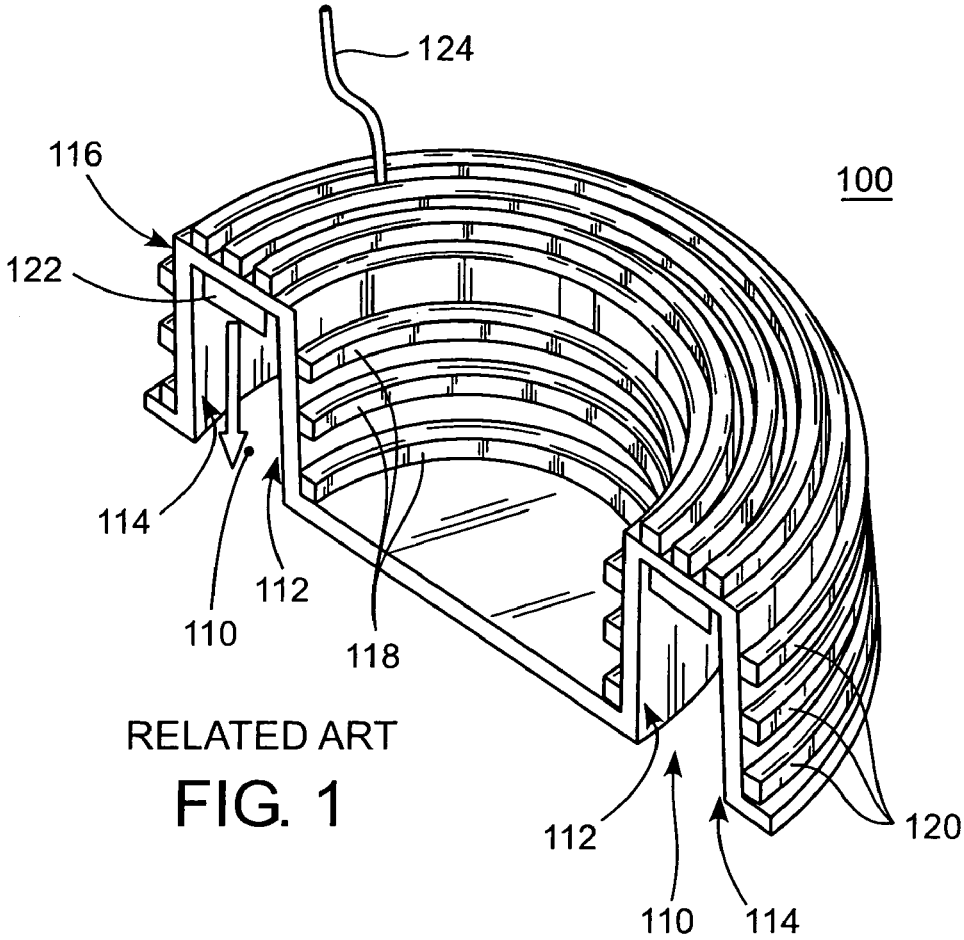
RELATED ART FIG. 1
FIG. 1 depicts a cut-away top perspective view of a conventional plasma accelerator.
Figure 2:
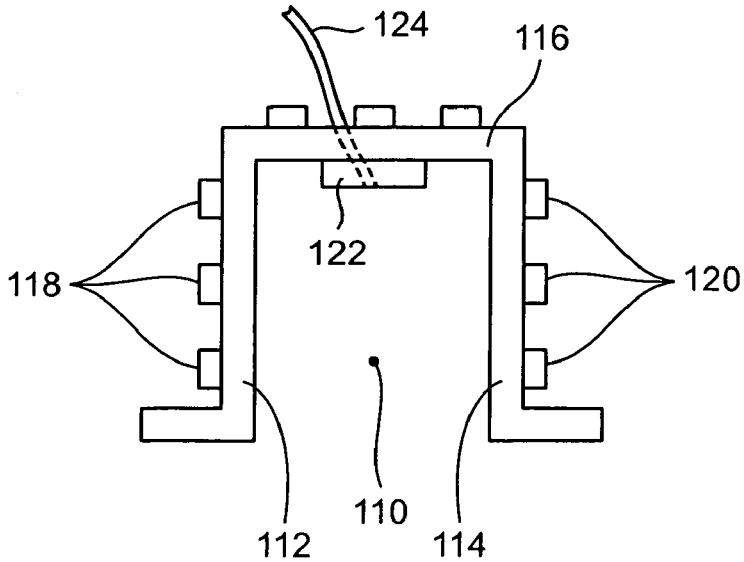
RELATED ART FIG. 2
FIG. 2 depicts a cross-sectional view of the conventional plasma accelerator 100 shown in FIG. 1.

The various coils 301-316 may each be electrically separated, different discharge inductor lines. In accordance with the various embodiments disclosed herein the coils may be divided into different groups or sections, (e.g., initial discharge section (309-316), acceleration section (303-308), and nozzle section (301-302). The different groups or sections of coils may be driven by signals of different frequency and phase. In some embodiments one or more of the coils 301-316 may wrap entirely around the accelerator 300 more than once. Further, some embodiments may be provided with an anode inside the chamber, similar to the anode 122 shown in FIG. 1A, for plasma generation purposes. Other embodiments may operate without an anode, simply using the end side coils 313-316 to generate plasma.

Currents are applied to the coils 301-316, inducing a magnetic field, B-field 340, inside of the channel 321. The flux density of B-field 340 depends upon the density of the coils 301-316 around the outside of chamber 321, the proximity of the coils to the chamber, and the amount of current flowing through the coils. For a given surface area of the accelerator chamber 321, the density of the coils increases as the number of windings of coils 301-316 increases. This, in turn, increases the density of the B-field 340 magnetic flux lines. For a given number of coils 301-316, increasing the current through the coils also has the effect of increasing the density of B-field 340. The magnetic flux lines form around each of the coils 301-316 in a direction perpendicular to the coil in accordance with the convention sometimes known as the right-hand rule. The magnetic flux lines in the space between adjacent coils 301-316 (e.g., between 301 and 303) flow in opposite directions and tend to cancel each other out. The flux lines of B-field 340 in chamber 321 tend to be additive since the area in chamber 321 is considerably outside the plane formed by adjacent coils.

The accelerator 300 includes one or more signal generation units 350 configured to provide pulsed or modulated signals to the coils 301-316. Various embodiments may entail the use of multiple signal generators 350 since, as discussed below, a different driving frequency and/or waveform is applied to each of several sections of the acceleration chamber 321. A gas supply 360 inputs gas via one or more supply lines 362 into the chamber 321. Controller 370 is configured to provide process control for the accelerator 300. The controller 370 may be connected via a bus or in other like manner to signal generation unit 350 and gas supply 360. To form plasma the signal generation unit 350 supplies pulsed current signals to end side coils 313-316 as gas is pumped into the chamber 321 near the coils. The signal pulses produce an electromagnetic field which is propagated through the gas, forming a plasma. In some embodiments which have an anode inside the chamber similar to the anode 122 of FIG. 1, the gas is pumped proximate to the anode. In other embodiments, there is no separate anode provided inside the chamber 321, and the gas is excited by the end side coils 313-316 to generate plasma.

Current propagating through the coils 301-316 induces a magnetic B-field within channel 321 and secondary current J. Current flowing through the inner side coils and the outer side coils in the directions indicated by the arrows of FIG. 3 produce a magnetic B-field oriented in the direction shown, out the aperture of chamber 321. The secondary current J generates an electric field having a sufficient strength to decompose an externally-supplied gas in a plasma state. The secondary current J and the magnetic B-field produce an electromagnetic force F in a direction along the axis, defined by the Lorentz force equation $F_L = j \times B$. Plasma ions are accelerated by the electromagnetic force $F_L$ through and out of the channel 321.

Plasma discharge is achieved by injecting gas via the gas supply lines 362 into an initial discharge section (e.g., proximate coils 309-316) of the accelerator chamber 321 and by modulating the current through the coils 309-316 of the initial discharge section. For example, a plasma discharge—the creation of plasma—may be initiated and maintained by applying an oscillating or pulsed current or voltage along the initial discharge section coils 309-316. In some embodiments, a D.C. voltage may be used in the generation of plasma discharges. In other embodiments the signals used to initiate and maintain the plasma discharge may include radio frequency (RF) signals, microwave frequencies, laser signals, or other high frequency waveforms.

One aspect of the various embodiments disclosed herein is that different driving frequencies and/or pulse forms are used for the coils 301-316 at different portions within the chamber 321. In some embodiments, the coils 301-316 may be divided into three categories or sections, each with a different purpose: initial discharge section (e.g., coils 309-316); acceleration section (e.g., coils 303-308); and nozzle section (e.g., coils 301-302). In other embodiments, further categories of coils may be used. For example, the initial discharge section could be further divided into an initial heating section (e.g., coils 313-316) and initial acceleration section (e.g., coils 309-312). Similarly, the acceleration section could be further divided into a mid acceleration section (e.g., coils 305-308) and a final acceleration section (e.g., coils 303-304). It is anticipated that the various embodiments cover other categories or sections of coils having more highly specialized functions, or functions with different purposes, that are understood by those of ordinary skill in the art. The different sections of coils operate at different frequencies. The coils of a particular section operate at the same frequency, but the coils are out of phase with each other. A phase relationship between adjacent coils or coil portion on a wall of the chamber within the same section are related insofar as the phases among the coils are adjusted according to desired plasma velocity. A coil on the inner wall 327 is in phase with a corresponding coil or coil portion on the outer wall 325 (in phase with 303). In other words, the different sections of coils operate at different frequencies. The coils of a particular section operate at the same frequency in the exemplary embodiments. The phases among the coils in a section are adjusted according to desired plasma velocity.

The initial discharge section (e.g., coils 309-316) generates the plasma and imposes an initial velocity on it for the following section of the chamber 321, the acceleration section. In embodiments of the plasma accelerator 300 using top coils for plasma generation rather than a conventional internal anode (e.g., anode 122), it has been found that a driving frequency of approximately 2 MHz yields very good results. This is much lower than the typical 13.5 MHz driving frequency of conventional devices using a plasma generation anode. Plasma may be generated in accelerator 300 by RF power (e.g., 2 MHz±0.5 MHz) of a non-resonant top coil having a number of turns, e.g., end coils 313-316. In various embodiments the end coil also produces the initial acceleration of the plasma in accordance with the Lorentz force equation, $F_L = j \times B$, where j is the induced plasma current density, and B is the magnetic field. The Lorentz force acts on the plasma electrons, applying force on them to move in the axial direction opposite to the end coils 313-316, in the direction shown in FIG. 3. This, in turn, leads to generation of the axial electrostatic ambipolar field $E_Z$ which tends to retard plasma electrons and accelerate plasma ions. The net result is the axial acceleration of the plasma as a whole.

Figure 5:
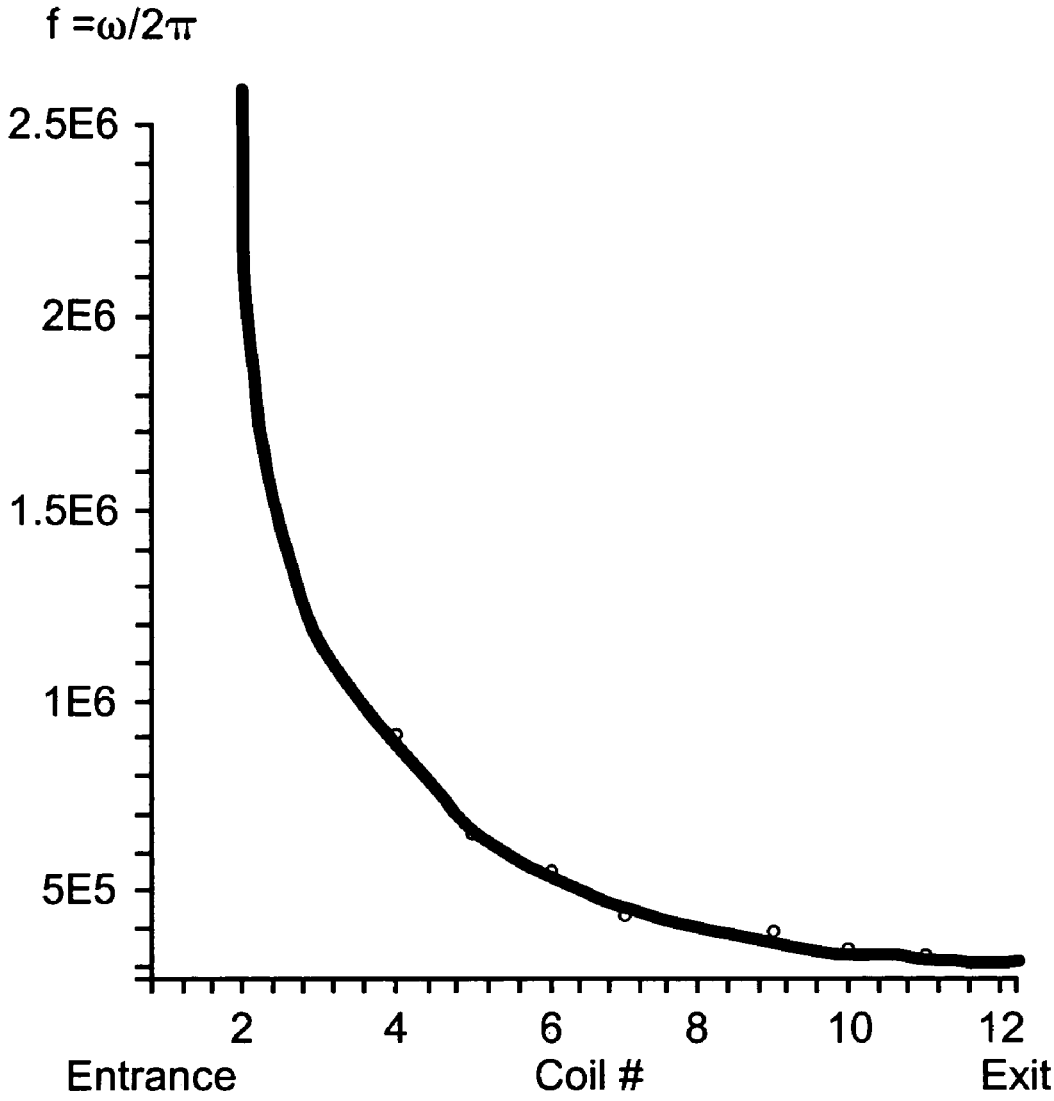
FIG. 5 depicts the optimal side coil driving frequency as a function of the number of coils (N)

The acceleration section (e.g., coils 303-308) receives plasma at an initial velocity from the initial discharge section, and in turn, accelerates the plasma. The accelerated plasma then passes from the acceleration section to the nozzle section. The driving frequency of the acceleration section coils 303-308 may be chosen different than the driving frequency of the end coils or the initial discharge section (e.g., coils 309-316). Further, the driving frequency signals in acceleration section coils 303-308 are out of phase with the driving frequency signals of the initial discharge section coils 309-316. The acceleration efficiency, sometimes known as the ion velocity or energy gain, tends to be a function of the number of the acceleration coils versus the acceleration coil driving frequency, as shown in FIG. 5. Selecting a driving frequency according to this relationship for the acceleration section (e.g., coils 303-308) will tend to produce the best results, approaching the maximal acceleration effect as the parameters are optimized.

FIG. 5 depicts the optimal side coil driving frequency as a function of the number of coils (N) according to at least one embodiment of the invention. This relationship may be used to select a number of coils and/or the driving frequency of the acceleration section. As shown in the figure, for N=6, the optimal side-coil frequency is about 0.5 MHz, considerably lower than the optimal top-coil driving frequency of 2 MHz. Various embodiments may be implemented by staying within a predetermined range of the optimal relationship shown in FIG. 5 (e.g., ±5%, ±10%, ±20%, or other like amount which is appropriate for the desired characteristics or for a given set of design considerations per computer simulations. In the disclosed embodiment, the driving frequency used in the nozzle section is the same as in the acceleration section. However, the nozzle section current amplitude and phase can be much different from the corresponding amplitude and phase in the acceleration section. The amplitude and phase of the nozzle section current are adjusted to obtain the best plasma flux uniformity.

The nozzle section (e.g., coils 301-302) receives plasma from the acceleration section and acts to create a uniform flow of plasma leaving the chamber nozzle.

Figure 6:
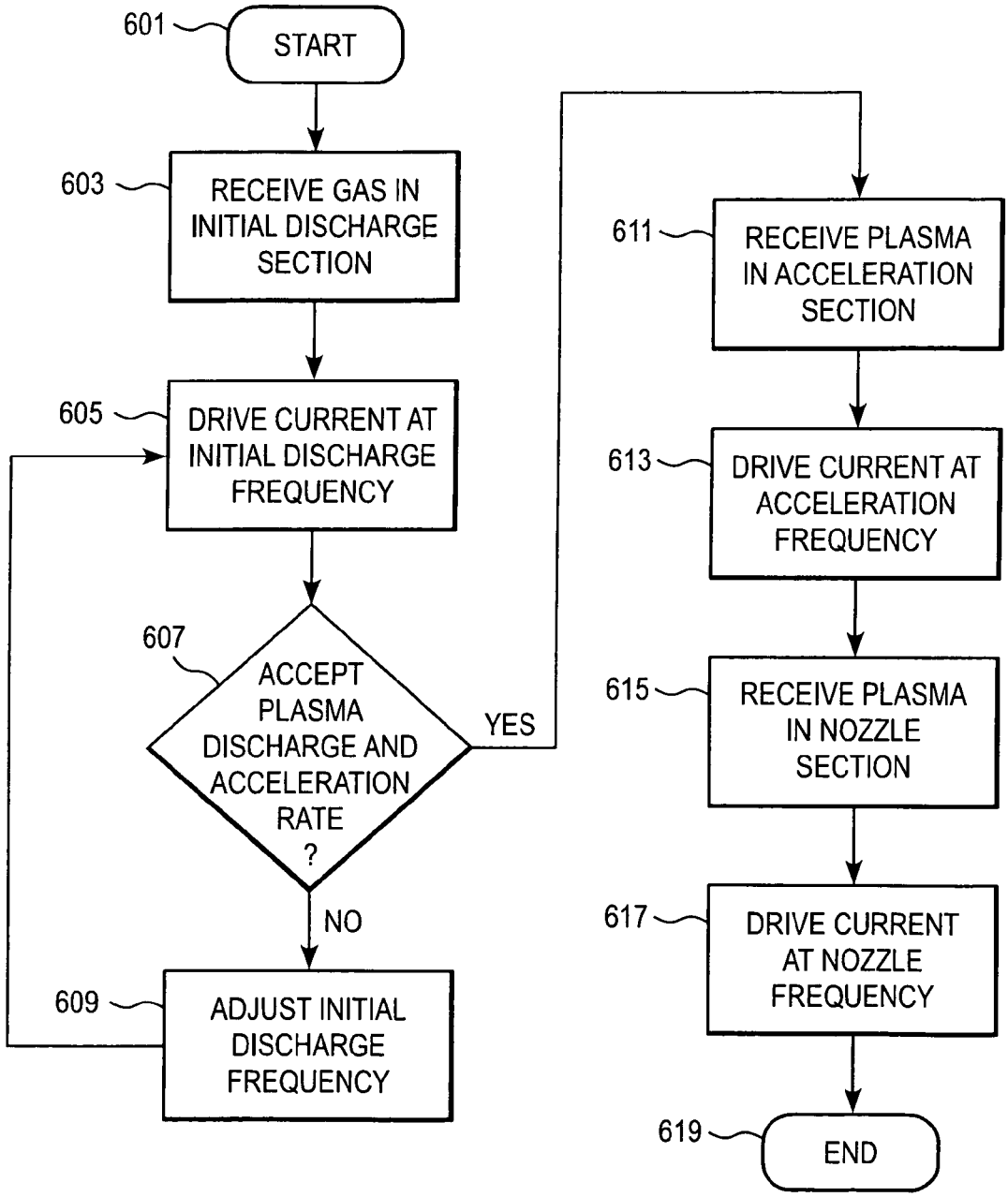
FIG. 6 is a method for modulating the driving frequency in a plasma accelerator according to various embodiments of the invention.

FIG. 6 is a method for modulating the driving frequency in a plasma accelerator according to various embodiments of the invention. The method begins in 601 and proceeds to 603 where gas is received via supply lines into an accelerator chamber. Gases which may be used for plasma discharge include Ar, $F_2$, $Cl_2$, $CH_4$, $GeH_4$, $CF_4$, $SiH_n^+$, either alone, combined with each other, or in combination with $O_2$, $H_2$ and $N_2$, or other like gases. The method proceeds to 605 and a drive current is applied to the coils of initial discharge section (e.g., coils 309-316 of FIG. 3). Depending upon the desired characteristics and parameters of the plasma process any of several types of drive currents may be used to generate a plasma discharge, including, pulsed signals, radio frequency (RF) signals, microwave frequencies, laser signals, or other like waveforms.

Once the drive current has been applied to the coils of initial discharge section the method proceeds to 607 where it is determined whether the plasma discharge and initial rate of acceleration is acceptable. If either the plasma discharge rate or the initial rate of acceleration is found to be unacceptable the method proceeds to 609 along the "NO" branch for adjustment of the discharge frequency or selection of another waveform. Block 609 may entail other adjustments to the process such as increasing or decreasing the gas pressure or altering the mixture of gases being used. Once the variable system parameters have been reset or adjusted, the method loops back to 605. If, in 607, the plasma discharge rate and the initial rate of acceleration are found to be acceptable the method proceeds to 611 along the "YES" branch.

In 611 the plasma, now accelerated to an initial velocity, passes from the initial discharge section and is received at the acceleration section (e.g., coils 303-308 of FIG. 3). The method proceeds to 613 where the acceleration drive current is applied to the acceleration section coils 303-308. The acceleration drive current may be determined by the relationship illustrated in FIG. 5, empirically, or by any other method known to those of skill in the art for optimizing the acceleration of plasma in a plasma chamber. For example, if the relationship of FIG. 5 is used with six coils in the acceleration section, the optimal drive frequency is about 0.5 MHz. Once the drive current is applied to the acceleration section coils, accelerating the plasma through the section, the method progresses from 613 to 615 where the plasma is received in the nozzle section (e.g., coils 301-302). Once the plasma passes from the acceleration section to the nozzle section, the method proceeds to block 617 where the nozzle drive current is applied to the plasma stream. The nozzle section of the accelerator chamber is characterized by a drive current which creates a uniform flow of plasma as the plasma stream exits the chamber. After the nozzle drive current is applied to the plasma stream the method passes from 617 to 619 where the method ends.

Various embodiments of the present invention have been disclosed herein and, although specific terms are employed, they are used and are to be interpreted in a generic and descriptive sense only and not for purpose of limitation. The invention should not be construed as being limited only to the embodiments set forth herein. The invention may be embodied in different forms or implemented in different manners. The various embodiments are provided herein to explain different aspects of the invention and so that those or ordinary skill in the art will appreciate the scope of the invention. Accordingly, it will be understood by those of ordinary skill in the art that various changes in form and details may be made without departing from the spirit and scope of the present invention as set forth in the following claims.

It should be emphasized that the terms "comprises" and "comprising", when used in this specification as well as the claims, are taken to specify the presence of stated features, steps or components; but the use of these terms does not preclude the presence or addition of one or more other features, steps, components or groups thereof.

Various embodiments of the invention have been described herein, but it will be appreciated by those of ordinary skill in this art that these embodiments are merely illustrative and that many other embodiments are possible. The intended scope of the invention is set forth by the following claims, rather than the preceding description, and all variations that fall within the scope of the claims are intended to be embraced therein.

What is claimed is:

1. An apparatus for accelerating a plasma, comprising:

a chamber configured with an end wall and with at least one side wall that is substantially parallel to an axial direction of said chamber;

a first coil disposed adjacent said end wall that operates at a first frequency to generate said plasma in a gas located within said chamber;

a plurality of second coils disposed around said chamber adjacent said side wall and spaced from one another along said axial direction, said second coils being operated at a second frequency and out of phase with one another to accelerate said plasma along said axial direction, where the number of second coils is dependent upon the second frequency;

a plurality of third coils disposed around said chamber adjacent said second side wall and spaced from one another along said axial direction, wherein the plurality of third coils is in a lower portion on one end of the chamber adjacent to a nozzle portion; and separate signal connections between a signal generation unit and each of the first, second and third coils, respectively.

2. The apparatus of claim 1, wherein said first frequency is less than 3 MHz.

3. The apparatus of claim 2, wherein said second frequency is less than said first frequency.

4. The apparatus of claim 3, wherein said first frequency is about 2 MHz, wherein said plurality of second coils comprises at least six of the second coils, and wherein said second frequency is about 0.5 MHz.

5. The apparatus of claim 1, wherein said plurality of second coils comprises six of the second coils, wherein the second coils are acceleration coils and the first frequency is the driving frequency and the second frequency is the acceleration frequency.

6. The apparatus of claim 1, wherein said plurality of third coils adjacent said second side wall operate at a third frequency substantially the same as said second frequency, wherein said first frequency is approximately 2 MHz and said second and third frequencies are each about 0.5 MHz.

7. The apparatus of claim 1, wherein the signal generation unit is configured to provide signals at the first frequency to the first coil, signals at the second frequency to said plurality of second coils, and signals at a third frequency to said plurality of third coils, wherein the first frequency is higher than each of the second and the third frequencies, respectively.

8. A method of accelerating a plasma in a chamber comprising:

driving a first coil at a first frequency to generate said plasma in a gas located within the chamber, said first coil being disposed adjacent an end wall of the chamber;

driving a plurality of second coils at a second frequency to accelerate the plasma along an axial direction of the chamber, said second coils being disposed adjacent a side wall and spaced from one another along said axial direction, wherein said second coils being operated at said second frequency are out of phase with one another, wherein the second frequency and the number of second coils depend on each other;

driving a plurality of third coils at the second frequency, said plurality of third coils being disposed adjacent a second side wall and spaced from one another along said axial direction, wherein the plurality of third coils is in a lower portion on one end of the chamber adjacent to a nozzle portion; and separate signal connections between a signal generation unit and each of the first, second and third coils, respectively.

9. The method of claim 8, wherein said first frequency is less than 3 MHz.

10. The method of claim 9, wherein said second frequency is less than said first frequency.

11. The method of claim 10, wherein said first frequency is about 2 MHz, wherein said plurality of second coils comprises at least six of the second coils, and wherein said second frequency is about 0.5 MHz.

12. A method of accelerating a plasma in a chamber comprising;

driving a first coil at a first frequency to generate said plasma in a gas located within the chamber, said first coil being disposed adjacent an end wall of the chamber;

driving a plurality of second coils at a second frequency to accelerate the plasma alone an axial direction of the chamber, said second coils being disposed adjacent a side wall and spaced from one another along said axial direction, wherein said second coils being operated at said second frequency are out of chase with one another, wherein the second frequency and the number of second coils depend on each other;

initially receiving gas in an initial discharge station in the chamber and setting the first frequency at an initial discharge frequency;

determining whether to accept the plasma discharge and acceleration rate after driving the first coil or to adjust the initial discharge frequency;

after accepting the plasma discharge and acceleration rate, receiving plasma in an acceleration station in the chamber downstream from the initial discharge station before driving the plurality of second coils;

receiving plasma from the acceleration station in the nozzle section in the chamber downstream from the acceleration station; and driving a third coil at a nozzle frequency.

* * * * *

UNITED STATES PATENT AND TRADEMARK OFFICE

CERTIFICATE OF CORRECTION

PATENT NO. : 7,309,961 B2
APPLICATION NO. : 11/274247
DATED : December 18, 2007
INVENTOR(S) : Won-Taek Park et al.

It is certified that error appears in the above-identified patent and that said Letters Patent is hereby corrected as shown below:

On the Title Page of the patent, add:

Section --(30) Foreign Application Priority Data

Nov. 29, 2005 (KR) 10-2004-0098487--

Signed and Sealed this

Twenty-ninth Day of April, 2008

JON W. DUDAS
*Director of the United States Patent and Trademark Office*